US005991966A

United States Patent [19]

Sproule

[11] Patent Number: 5,991,966

[45] Date of Patent: Nov. 30, 1999

[54] APPARATUS FOR CLEANING ATHLETIC EQUIPMENT

[76] Inventor: Roger Allen Sproule, 997 Park Hill Cir., Aurora, Ill. 60504

[21] Appl. No.: 09/116,454

[22] Filed: Jul. 16, 1998

[51] Int. Cl.[6] ..... A47L 5/14

[52] U.S. Cl. ..... 15/310; 15/316.1; 15/405; 239/436; 239/536

[58] Field of Search ..... 15/310, 316.1, 15/301, 405; 239/536, 436, 146

[56] References Cited

U.S. PATENT DOCUMENTS

| | | | |
|---|---|---|---|
| 3,568,238 | 3/1971 | Fischer | 15/316.1 |
| 4,183,115 | 1/1980 | Zakarian | 15/316.1 |
| 5,064,123 | 11/1991 | Aiello et al. | 239/146 |
| 5,443,211 | 8/1995 | Young et al. | 239/146 |
| 5,555,643 | 9/1996 | Guasch | 15/405 |

*Primary Examiner*—Terrence R. Till
*Assistant Examiner*—Theresa T. Snider
*Attorney, Agent, or Firm*—Wallenstein & Wagner, Ltd.

[57] ABSTRACT

A cleaning system includes a housing, an air compressor, a plurality of air hoses, and a plurality of air nozzles. The housing has a first plurality of sidewalls. The first plurality of sidewalls define an enclosure. The housing includes at least a first opening defined therein. The first opening communicates with the enclosure. The air compressor is mounted within the enclosure. The plurality of air hoses are coupled to the compressor and extend through the first opening. The plurality of air nozzles are coupled to the air hoses. An apparatus includes a housing, a cleaning platform, an air compressor, at least one air hose, and an air nozzle. The housing includes a first plurality of sidewalls. The first plurality of sidewalls define an enclosure and have at least a first opening defined therein. The first opening communicates with the enclosure. The housing also includes a second plurality of sidewalls. The second plurality of sidewalls define a chamber. The cleaning platform is mounted to the second plurality of sidewalls. The cleaning platform has at least a second opening defined therein. The second opening communicates with the chamber. The air compressor is mounted within the enclosure. The air hose is coupled to the compressor and extends through the first opening. The air nozzle is coupled to the air hose.

17 Claims, 4 Drawing Sheets

APPARATUS FOR CLEANING ATHLETIC EQUIPMENT

BACKGROUND OF THE INVENTION

1. Field of the Invention

This invention relates generally to cleaning devices, and more particularly, to an apparatus for cleaning athletic equipment, such as golf equipment.

2. Description of the Related Art

Many activities, such as outdoor athletic activities, involve the use of various equipment during inclement weather or otherwise foul conditions. As a result the equipment may become soiled with grass, mud, etc. In sports requiring spiked shoes, such as golf, baseball, and soccer, it is common for the shoes to become soiled due to the constant interaction between the spikes and the turf. The soiling problem may be exacerbated during rainy or wet conditions.

A common apparatus for cleaning golf shoes includes an upturned bristle pad or other bristled surfaces. Such a bristled device, although suitable for dry conditions where dust and grass are readily removed, is unsuitable for wet conditions. The mud and/or wet grass is not easily removed by a bristled surface. Moreover, repeated brushing on a shoe may cause wear or other damage to the shoe.

The present invention is directed to overcoming, or at least reducing the effects of, one or more of the problems set forth above.

SUMMARY OF THE INVENTION

One aspect of the present invention is seen in a cleaning system including a housing, an air compressor, a plurality of air hoses, and a plurality of air nozzles. The housing has a first plurality of sidewalls. The first plurality of sidewalls define an enclosure. The housing includes at least a first opening defined therein. The first opening communicates with the enclosure. The air compressor is mounted within the enclosure. The plurality of air hoses are coupled to the compressor and extend through the first opening. The plurality of air nozzles are coupled to the air hoses.

Another aspect of the present invention is seen in an apparatus including a housing, a cleaning platform, an air compressor, at least one air hose, and an air nozzle. The housing includes a first plurality of sidewalls. The first plurality of sidewalls define an enclosure and have at least a first opening defined therein. The first opening communicates with the enclosure. The housing also includes a second plurality of sidewalls. The second plurality of sidewalls define a chamber. The cleaning platform is mounted to the second plurality of sidewalls. The cleaning platform has at least a second opening defined therein. The second opening communicates with the chamber. The air compressor is mounted within the enclosure. The air hose is coupled to the compressor and extends through the first opening. The air nozzle is coupled to the air hose.

BRIEF DESCRIPTION OF THE DRAWINGS

Other objects and advantages of the invention will become apparent upon reading the following detailed description and upon reference to the drawings in which.

Figure 1:
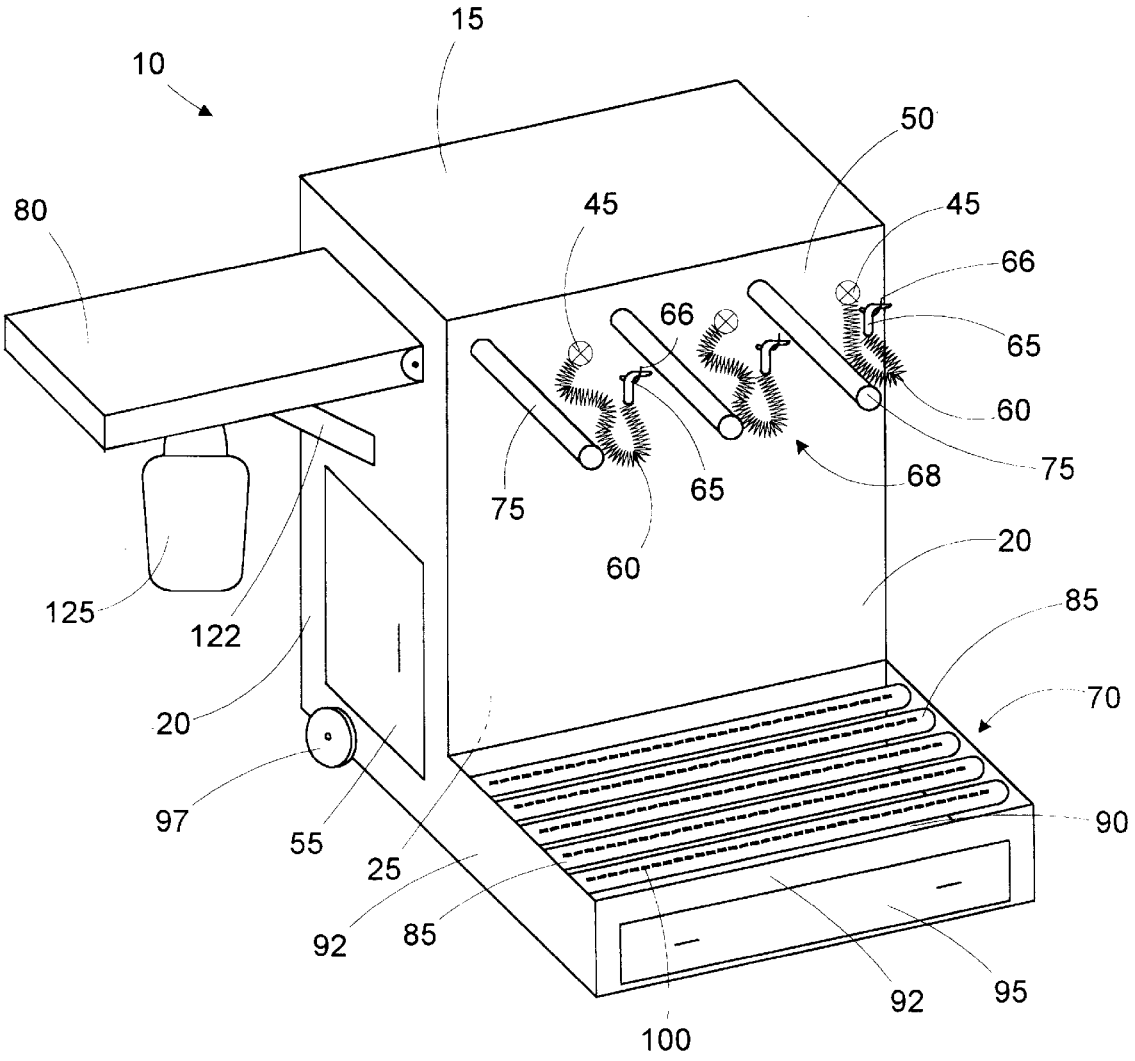
FIG. 1 illustrates an isometric view of a cleaning system in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
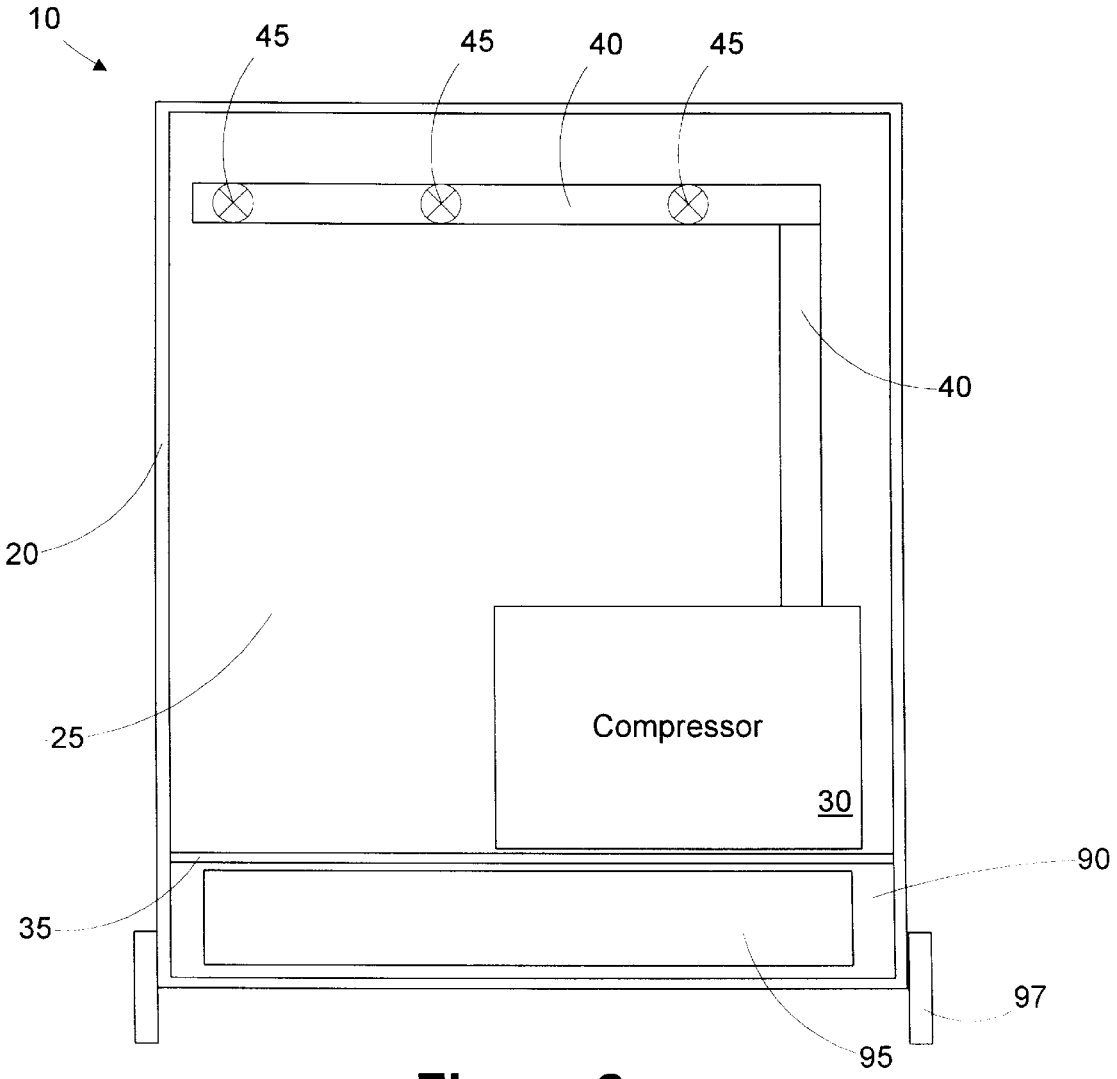
FIG. 2 illustrates a back view of the cleaning system of FIG. 1.

Referring now to the Figures and, in particular to FIG. 1, an isometric view of a cleaning system 10 in accordance with the present invention is shown. The cleaning system 10 includes a housing 15 having a plurality of sidewalls 20. Collectively, the sidewalls 20 define an enclosure 25. An air compressor 30 is mounted within the enclosure 25. A back view of the cleaning system 10 with one of the sidewalls 20 removed is shown in FIG. 2.

In the illustrated embodiment, the compressor 30 is shown mounted to the floor 35 of the enclosure 25. Alternatively, the compressor 30 may be mounted in other positions depending on specific design parameters, such as the size and weight of the compressor 30. For example, the compressor 30 may be mounted to one of the sidewalls 20.

The cleaning system 10 includes an air manifold 40 for distributing compressed air to a plurality of air connections 45. The air manifold 40 may comprise piping (e.g., rigid or flexible) or flexible hose with appropriate connecting fittings (not shown). In the illustrated embodiment, the portion of the air manifold 40 including the air connections 45 may be mounted to the front sidewall 50, either inside or external to the enclosure 25.

Returning to FIG. 1, an access panel 55 communicates with the enclosure 25 to allow installation or maintenance of the compressor 30. The access panel 55 may be located in numerous locations in the housing 15, depending on the placement of the compressor 30 within the enclosure 25. A plurality of air lines 60 are coupled to the corresponding air connections 45. The air lines 60 may comprise standard straight hose or, as illustrated, a pre-coiled hose (i.e., having a spring-like shape). Air nozzles 65 are coupled to each of the air lines 60 for dispersing a stream of compressed air. The air nozzles 65 generally provide a narrow, focused air stream useful for cleaning a soiled item (e.g., golf shoe). Mounting devices, such as hooks 66, are attached to the front sidewall 50 for supporting each air line 60 and air nozzle 65. The description herein focuses on the use of the invention to clean golf equipment. However, other uses, including those described above, are contemplated.

Collectively, one air connection 45, air line 60, and air nozzle 65 defines a cleaning station 68. In the illustrated embodiment, three cleaning stations 68 are depicted, however, the number of cleaning station 68 may vary depending on, for instance, the expected traffic of golfers at a given location or golf course. The size and capacity of the compressor 30 depends in part on the number of cleaning stations 68 installed in the cleaning system 10.

The compressed air is useful for removing a variety of debris, including dust, grass, mud, etc. The wetness of the conditions do not adversely affect the effectiveness of the cleaning system 10. In wet conditions, the compressed air from the air nozzles 65 will disperse wet grass or mud, and may even have a drying effect on the item (not shown) being cleaned.

The cleaning system 10 may include additional features such as the cleaning platform 70, support rails 75, and accessory table 80. The support rails 75 mounted to the front sidewall 50 proximate the air connections 45 provide support for users of the cleaning system 10 during the cleaning of their golf shoes (not shown). The cleaning platform 70 includes a plurality of spaced tubes 85. Alternatively, the cleaning platform 70 may include spaced rods (not shown), grating (not shown), or some other structure (not shown) having spaces defined therein. Debris passes through the cleaning platform 70 into a collection chamber 90 defined below the cleaning platform 70 by a second set of sidewalls 92 that support the cleaning platform 70. In the illustrated embodiment, a drawer 95 is positioned in the collection chamber 90 to facilitate collection and removal of the collected debris. Although the drawer 95 is illustrated in the front of the second set of sidewalls 92, it may be located in a variety of positions (e.g., on the side of the sidewalls 92). Wheels 97 are provided to enhance the portability of the cleaning system 10. In addition, handles (not shown) may be provided for moving the cleaning system 10 in conjunction with the wheels 97.

The cleaning platform 70 may include bristle strips 100 mounted to the tubes 85 for providing additional frictional cleaning (e.g., to pre-clean the golf shoe (not shown) prior to applying compressed air). Not all tubes 85 may include bristle strips 100.

Figure 3:
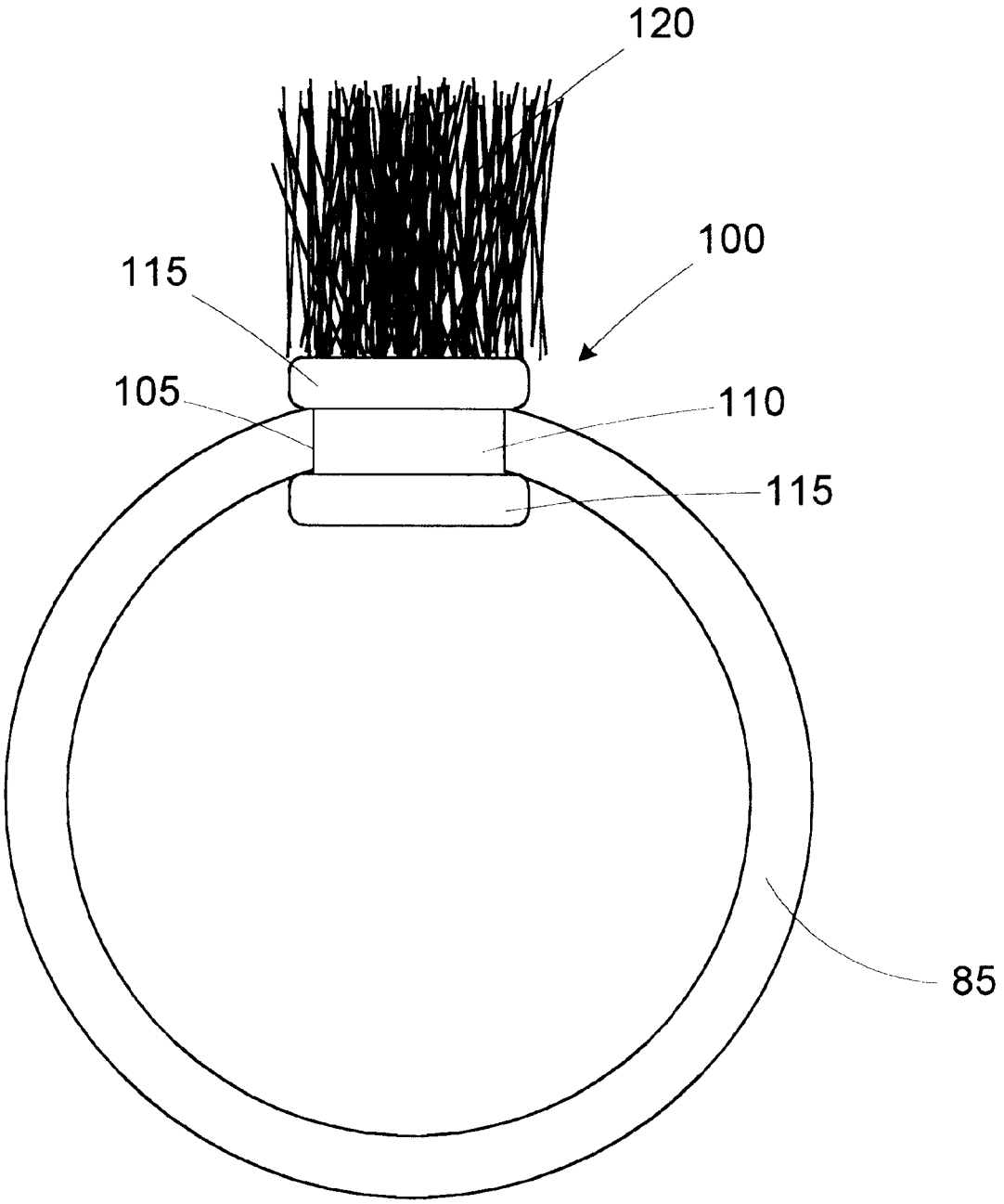
FIG. 3 is a cross section of a bristled cleaning bar of the cleaning system of FIG. 1.

FIG. 3 illustrates a cross-section of one of the tubes 85 showing a bristle strip 100 mounted to the tubes 85. A slot 105 is defined in the tube 85 for receiving a bristle strip base 110 (e.g., by cutting). The slot 105 may extend the entire length of the tube 85, or alternatively may be cut in only portions of the tube 85. For example, patches of the bristle strips 100 may be localized to form a bristle pad (not shown) near each cleaning station 68. The bristle strip base 110 has enlarged shoulders 115 for retaining the bristle strip base 110 in the slot 105. Bristles 120 extend from the bristle strip base 110. The bristle strip base 110 may comprise a compressible, elastomeric compound that may be forced through the slot 105. Alternatively, the bristle strip base 110 may comprise a rigid material, such as metal, that is inserted into the slot 105 from an end of the tube 85 prior to mounting the tube 85 in the cleaning platform 70.

FIG. 3 illustrates only one possible means for mounting the bristle strips 100 to the tubes 85. Other mounting methods, such as, for example, welding, gluing, or fastening, are contemplated.

Figure 4:
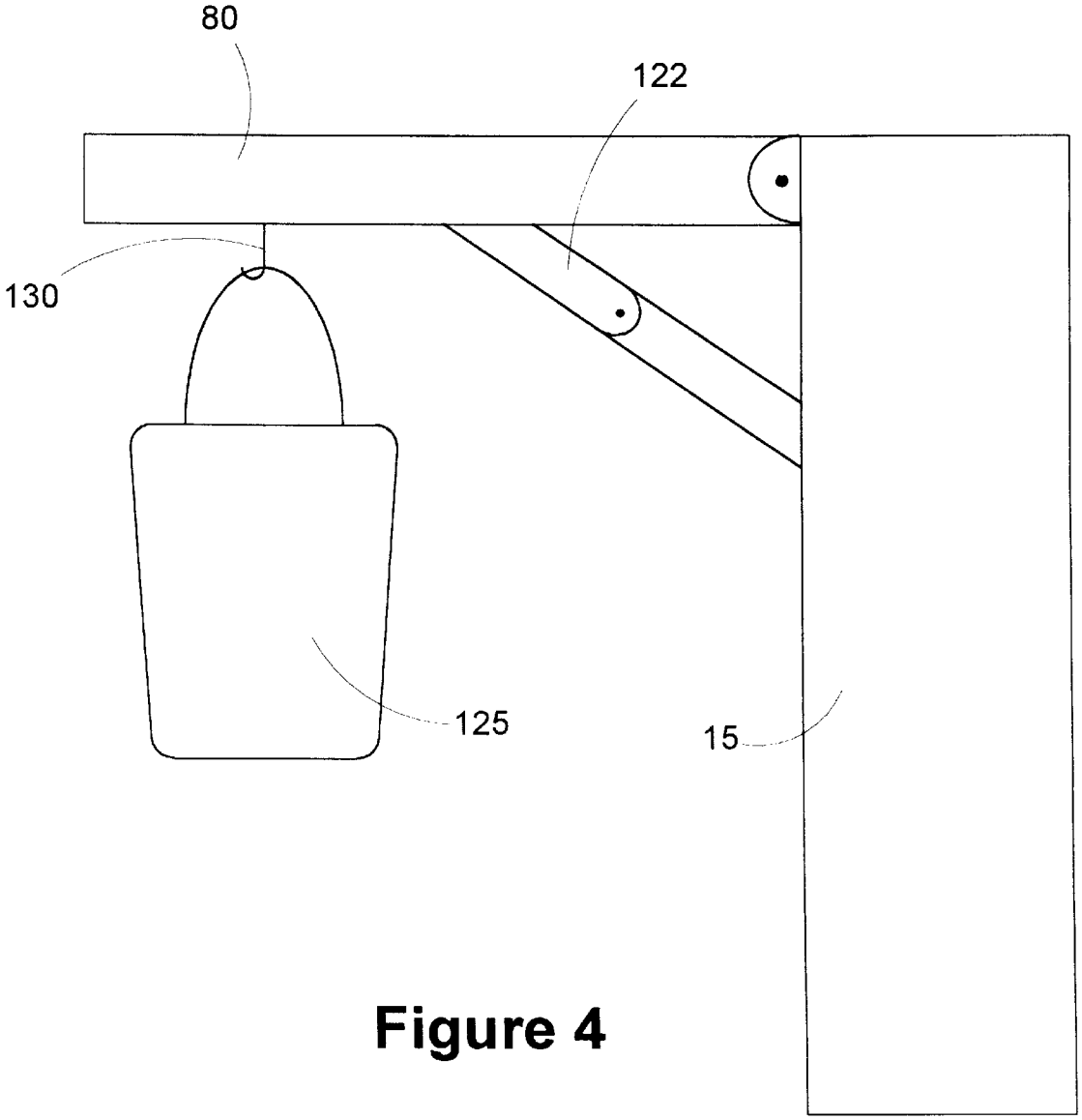
FIG. 4 is a partial front view of an accessory table of the cleaning system of FIG. 1.

Returning to FIG. 1, the cleaning system 10 includes an accessory table 80 mounted to one of the sidewalls 20. FIG. 4 illustrates a front view a portion of the cleaning system 10 including the accessory table 80. The accessory table 80 is supported by a hinged member 122 coupled between the sidewall 20 and the accessory table 80. The accessory table 80 may be used by a user of one of the cleaning stations 68 to clean golf clubs or the like. A bucket 125 containing cleaning solution (e.g., water or soapy water) may be hung from a hook 130 attached to the accessory table 80 to facilitate such cleaning.

The materials of construction used in the cleaning system 10 are resistant to degradation due to outdoor exposure. The housing 15 support rails 75, and/or tubes 85 may be formed of galvanized or painted metal, plastic, etc., to resist oxidation.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A cleaning system, comprising:

a housing having a first plurality of sidewalls, said first plurality of sidewalls defining an enclosure;

an air compressor mounted within the enclosure;

a plurality of air hoses coupled to said compressor and extending through one of said first plurality of sidewalls; and a plurality of air nozzles coupled to said air hoses.

2. The cleaning system as set forth in claim 1, further comprising:

an air manifold coupled to said compressor; and a plurality of air connections coupled to said air manifold, wherein each of said connections is coupled to one of said plurality of air hoses.

3. The cleaning system as set forth in claim 1, further comprising:

a second plurality of sidewalls extending from at least one of the first plurality of sidewalls, the second plurality of sidewalls defining a chamber; and a cleaning platform mounted to said second plurality of sidewalls, said cleaning platform having at least one opening defined therein, the opening in said cleaning platform communicating with the chamber.

4. The cleaning system as set forth in claim 3, further comprising a drawer mounted to said second plurality of sidewalls, the drawer being located within the chamber and beneath the opening in said cleaning platform.

5. The cleaning system as set forth in claim 3, wherein the cleaning platform comprises a plurality of spaced members and the opening in said cleaning platform is defined between adjacent members.

6. The cleaning system as set forth in claim 5, wherein the spaced members comprises at least one of a plurality of tubes, a plurality of rods, and a grating.

7. The cleaning system as set forth in claim 5, wherein the cleaning platform further comprises:

a slot defined in at least a portion of one of the spaced members; and a bristle strip mounted within said slot.

8. The cleaning system as set forth in claim 3, further comprising a plurality of bristles mounted to said cleaning platform.

9. The cleaning system as set forth in claim 1, further comprising a plurality of support rails mounted to a front sidewall of the first plurality of sidewalls.

10. The cleaning system as set forth in claim 1, further comprising a plurality of mounting members coupled to a front sidewall of the first plurality of sidewalls, wherein the mounting members are adapted to support said air nozzles.

11. The cleaning system as set forth in claim 1, further comprising an accessory table mounted to said housing.

12. The cleaning as set forth in claim 11, wherein the accessory table is pivotably mounted to the housing.

13. An apparatus, comprising:

a housing, the housing including:

a first plurality of sidewalls, said first plurality of sidewalls defining an enclosure and having at least a first opening defined in one of the first plurality of sidewalls, the first opening communicating with the enclosure; and a second plurality of sidewalls extending from at least one of the first plurality of sidewalls, said second plurality of sidewalls defining a chamber;

a cleaning platform mounted to said second plurality of sidewalls, said cleaning platform having it least one opening defined therein, the opening in said cleaning platform communicating with the chamber;

an air compressor mounted within the enclosure;

an air hose coupled to said compressor and extending through the first opening; and an air nozzle coupled to said air hose.

14. The apparatus as set forth in claim 13, wherein the cleaning platform comprises a plurality of spaced members and the opening in the cleaning platform is defined between adjacent members.

15. The apparatus as set forth in claim 13, further comprising a support rail mounted to a front sidewall of the first plurality of sidewalls.

16. The apparatus as set forth in claim 13, further comprising a mounting member coupled to a front sidewall of the first plurality of sidewalls, wherein the mounting member is adapted to support said air nozzle.

17. The apparatus as set forth in claim 13, further comprising an accessory table mounted to said housing.

* * * * *